United States Patent [19]

Mitchell

[11] Patent Number: 4,461,479

[45] Date of Patent: Jul. 24, 1984

[54] GOLF CLUB HAVING WEIGHTED HANDLE

[76] Inventor: Michael D. Mitchell, 200 N. Cardinal Ave., Addison, Ill. 60101

[21] Appl. No.: 353,581

[22] Filed: Mar. 1, 1982

Related U.S. Application Data

[63] Continuation-in-part of Ser. No. 234,392, Feb. 13, 1981, abandoned.

[51] Int. Cl.[3] ..... A63B 53/14

[52] U.S. Cl. ..... 273/81 A; 273/80 A; 273/77 A

[58] Field of Search ..... 273/81 A, 169, 170, 273/171, 77 A, 81 D, 165, 80 A

[56] References Cited

U.S. PATENT DOCUMENTS 1,696,462 12/1928 Victor ..... 273/81 A 2,051,083 8/1936 Hart ..... 273/81 A

*Primary Examiner*—George J. Marlo

*Attorney, Agent, or Firm*—Dressler, Goldsmith, Shore, Sutker & Milnamow, Ltd.

[57] ABSTRACT

A golf club is provided with a grip end having increased weight in order to improve the accuracy and control of the swinging of the golf club. The golf club has a head, a shaft having an outer end, and a balance point at a location intermediate the ends of the golf club. A weighted member is mounted to the golf club between the location of the balance point and the outer end of the golf club. The weighted member is in intimate contact with the inner surface of the hollow club shaft and has an enlarged head portion abutting the outer end of the shaft. The weighted member is encased in a flexible sleeve for absorbing thermal and mechanical stresses during use of the club. The weighted member moves the balance point of the golf club from the original location of the balance point to a new point that is between the original location and the outer end of the club.

12 Claims, 8 Drawing Figures

PRIOR ART

FIG. 6
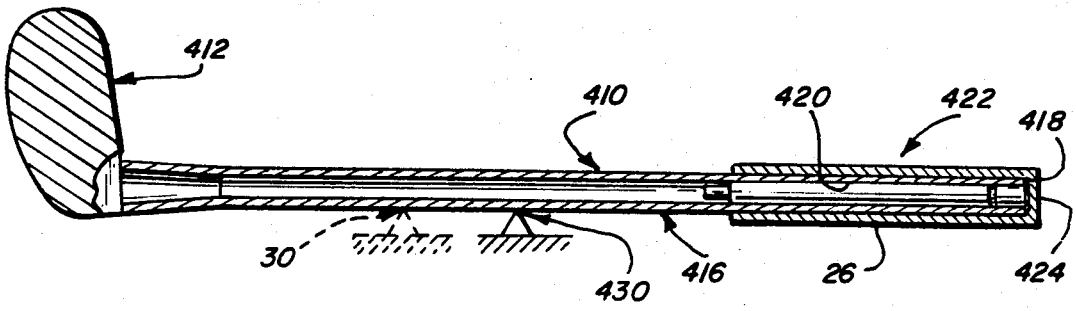
FIG. 7
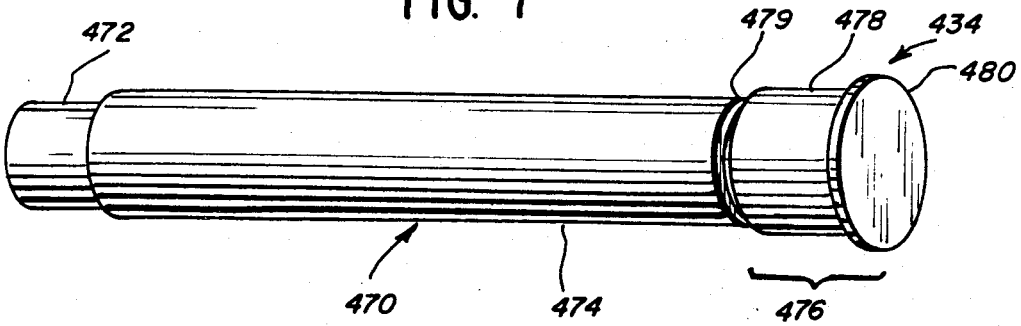
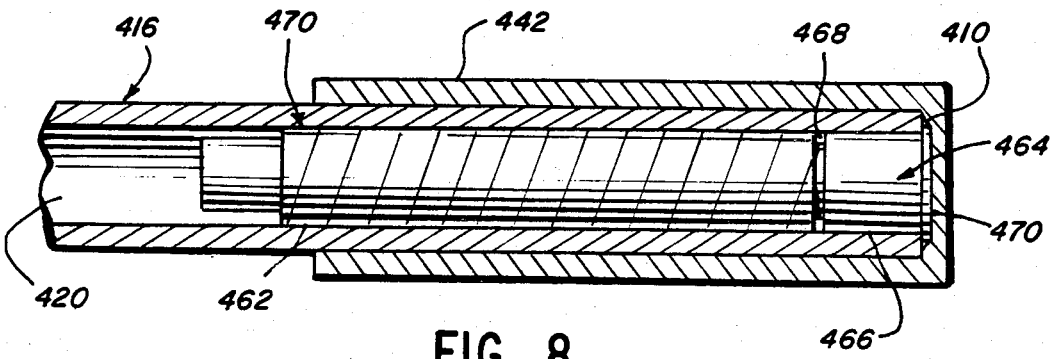
FIG. 8

GOLF CLUB HAVING WEIGHTED HANDLE

This application is a continuation-in-part of my application Ser. No. 234,392, filed Feb. 13, 1981, now abandoned.

TECHNICAL FIELD OF THE INVENTION

The present invention relates to athletic implements, such as golf clubs, that have improved weight distribution wherein additional weight is provided in the handle or shaft.

BACKGROUND OF THE INVENTION

Numerous athletic games require the use and swinging of an athletic implement that has a head portion and a shaft. Examples of such athletic implements include golf clubs, tennis rackets, hockey sticks, polo sticks and baseball bats.

One of the problems that has long existed in these athletic endeavors is the accuracy of the control of the athletic implement when it is being swung by the player. For example, in the game of golf, loss of control of the golf club occurs during the back swing when the head portion deviates from the plane in which the club should remain. As a result, there is a disadvantageous loss of control of the club which prevents golfers from experiencing optimum results in striking the golf ball during the forward portion of the swing.

A number of prior art devices have attempted to improve the accuracy and consistency of the golf swing by adding weight to the head portion of the golf club. Examples of these devices are disclosed in U.S. Pat. No. 3,743,297 to Dennis, U.S. Pat. No. 3,749,408 to Mills and U.S. Pat. No. 4,017,083 to Johnson. U.S. Pat. No. 3,360,268 to Molinari also discloses a golf swing device that is secured to the head of a golf club.

Other attempts at solving the foregoing problems relate to the addition of weight to the shaft of the golf club either directly adjacent to the head, or somewhere along a lower portion of the shaft. See, for example, U.S. Pat. No. 2,608,409 to Pinkerton, U.S. Pat. No. 2,950,115 to Hurdzan, U.S. Pat. No. 3,317,211 to Debski, U.S. Pat. No. 3,419,275 to Winkleman, U.S. Pat. No. 3,608,907 to Bouchard, U.S. Pat. No. 3,647,220 to Burkart et al., U.S. Pat. No. 3,680,870 to Burnett et al., U.S. Pat. No. 3,716,239 to Goudreau, U.S. Pat. No. 3,740,053 to Eiger, and Canadian Pat. No. 710,688 to MacBrill.

U.S. Pat. No. 3,521,883 to Hamilton is similar to the foregoing patents in that it discloses the use of a training weight that is added to the head portion of a baseball bat.

The foregoing patents disclose devices that are disadvantageous because the weight is added at a location that is further from the handle of the athletic implement than the location of the center of gravity of the unweighted implement. As a result, the additional weight moves the center of gravity or balance point of the athletic implement further from the location where a person holds the device. This has a tendency to increase the deviation from the desired plane when a person is swinging the athletic implement.

Some have recognized the deficiencies of the above prior art and have attempted to overcome such deficiencies with the idea of redistributing the weight along the device. Thus, attempts have been made to add weight adjacent to the hand held portion of the device to improve control of and the resulting accuracy of the movement of the athletic device. If this can be done, it would be possible to control the implement more precisely and maintain it in the desired plane of movement when the implement is swung.

In the above cited MacBrill Canadian Patent there is disclosed a golf club in which a variety of approaches are disclosed in an attempt to redistribute the weight of the club along the shaft. The various embodiments disclosed include weights disposed intermediate the ends and weights which offset the grip from the portion of the shaft adjacent to the head of a golf club. MacBill also discloses modifying the shape of the shaft to increase its thickness to allow for addition of a weight such as lead poured into a hole drilled portion in the widened part of the shaft which also provides shaft offset. Other variations provide means for adding weight to the lower portion of the shaft such as by increasing the thickness of the shaft which also operates to reduce whip. These approaches have limited if any utility. They would not be suitable for use in athletic implements such as golf clubs (except possibly a putter) in which the whip and flexing of the shaft is an integral part of the use of the club. These variations disclosed in the MacBrill Canadian patent involve significant and substantial modification to the basic configuration athletic implement such as a golf club which detracts from the suitability of use and have limited practical utility.

In another embodiment, MacBrill discloses a weighted plug inserted into the hollow shaft from the free gripping end which is designed to be retained in position by having the shaft crimped or possibly cemented to the inner-surface of the hollow shaft. The deficiences of this approach is discussed in more detail below.

British Pat. No. 11,118 dated July 6, 1901 shows a hollow end cap adapted to be threadedly attached to the end of a solid shaft and to have disposed therein at the end of the shaft a weighted material such as lead.

Hart U.S. Pat. No. 2,051,083 discloses what is described as a golf shaft balancer which in effect is a weighted insert adapted to pass into a hollow shaft and be longitudinally positionable as well as rotatable within the shaft to give the shaft a desired feel. The balancer is described as being particularly useful in putters which in fact do not have an extended amount of flex when used.

Lynch U.S. Pat. No. 1,210,182 also discloses a solid club in which a lead weight is supported at one end and enclosed by a ferule or cap affixed to the end of the solid shaft club.

Karns U.S. Pat. No. 3,075,768 provides a compartment in one end of a golf shaft in which is disposed in a separate container or sack containing weighted particulate material. Alternatively, a plug is disposed within the shaft and frictionally or adhesively retained in place on top of which is positioned the particulate or shot material which is to be retained in place by a plug or adhesive.

While the above references disclose attempts to balance a athletic implement shaft of the type that is swung such as a golf club, tennis racket or baseball bat by placement of additional weight in the area which is grasped, none of the techniques shown or embodiments disclosed have been produced commercially, to applicant's knowledge.

In particular with respect to golf clubs, but with respect to any other such type of athletic implement particularly those which are swung to strike an object such as a ball and impart movement thereto, there are substantial stresses and strains imparted to the implement in use. As a result, the distortions that often occur induce a significant and large stress on objects such as weights which may be incorporated as part of the shaft.

In applicant's experience, the effect of such forces is to cause the weighted material to crack, shatter and come loose from its position within the shaft.

As a result, the weight begins to move around and rattle within the shaft. The weight either moves longitudinally, shifts in place, or both. In any event, the result is an undesirable change of the characteristics of the implement, and a highly disturbing rattling and noise.

All of such deficiencies have inhibited the actual use of such weights in such athletic implements. It is for at least these reasons that those ideas for adding weight in various places along the shaft of the implement have been unsuccessful. In order to be able to provide the desired balance to the shaft as suggested in the references mentioned above, it is imperative that any additional weight added to the implement be permanently maintained in place without the possibility of destruction or damage, and certainly without any movement thereof so that the player or user of the implement does not sense that the weight has been added except for the beneficial effect which the additional weight has on the use and control of the athletic implement.

SUMMARY OF THE INVENTION

In accordance with the present invention there is provided an athletic implement such as golf club, tennis racket, polo stick, baseball bat or other device having a head portion at one end and an elongated shaft or rod means extending to the opposite end which is adapted to be held. An additional weight is incorporated at the opposite held end for redistributing the weight along the athletic implement. The weight is retained in place without movement, noise or shifting of position, and the weight used does not shatter or destruct when the implement is used.

The athletic implements with which the present invention is particularly useful are those in whiCh the balance point is located intermediate the opposite ends thereof and is normally of the type adapted to be swung to strike an object such as a ball to impart movement thereto, and in which it is important to control the motion and path of the implement in order to properly strike the object and impart desired movement thereto.

Such athletic implements may comprise a golf club, tennis racket, polo stick, baseball bat or other athletic device having a head portion at one end and rod or shaft means at the opposite end for holding the athletic implement. The athletic implement has a balance point at a location intermediate the ends thereof.

If a weight is mounted to the implement between the location of the balance point and the distal end of the rod or shaft, i.e., the end opposite the head portion, the added weight moves the balance point closer to the distal end. The weight is preferably mounted to the implement in the area where the player holds the implement.

One of the athletic implements with which this invention can be used is golf clubs. A golf club has a head with a first predetermined weight, a shaft having one end secured to the head and an opposite outer end. A grip is secured to the shaft adjacent to the outer end of the shaft.

The weight means preferably is secured to the golf club within about one-third of the length of the club from the outer, gripping end of the club. The weight means has a second predetermined weight, whereby the total weight of the club within one-third of the length of the club from the outer end, which is within about twelve inches of the outer end, is increased.

By adding the weight means to the golf club, the balance point or center of gravity of the club is moved from its original location to a point that is closer to the outer end of the golf club, and is thereby closer to the area where a person grips the golf club. It appears desirable to add the weight means to shift the center of gravity or balance point from its original location which is closer to the head end towards a point which is about midway of the length of the entire club. This enables the person to exert greater accuracy and control in swinging the club, thereby improving the golf game.

A method in accordance with the present invention of improving the weight distribution of an athletic implement such as a golf club to enable a player to more accurately control the movement of the club, comprises the steps of adding weight to the golf club between the location of the balance point of the unweighted club and the outer end of the shaft, and moving the balance point by means of the added weight from the first location closer to the head end to a point between the first location and the outer end of the shaft, typically about midway between the ends of the club.

More specifically, in accordance with the present invention there is provided a weight means constructed of a solid material such as copper or steel which may be inserted into the hand held end of a hollow shaft forming part of an athletic implement. The weight is constructed to prevent any movement thereof when inserted and to resist shattering, disassociation or disintegration which might result from physical and thermal shocks during use of the implement. The weight does not produce an unwholesome or unsatisfactory sound does give rise to undesireable changes the characteristics of the implement in terms of feel or sound, but does provide the desired improved control of the implement in use.

Thus, in accordance with the present invention the weight is adapted to be inserted into the end of the shaft of an athletic implement such as a golf club and is configured to preclude movement longitudinally of the shaft. The weight is provided with a coating or sleeve thereon prior to insertion which retains its flexibility over a wide range of temperature, and therefore which resists sound and shock vibration to preclude movement of the weight and rattling in the club all of which is intolerable in the use of such athletic implements.

Numerous other advantages and features of the present invention will become readily apparent from the following detailed description of the invention and of one embodiment thereof, from the claims and from the accompanying drawing in which each and every detail shown is fully and completely disclosed as a part of this specification in which like numerals refer to like parts.

BRIEF DESCRIPTION OF THE DRAWING

FIG. 6 is a cross-sectional view of a golf club incorporating the present invention showing the shift in the center of gravity or balance point;

FIG. 7 is an enlarged side view showing one embodiment of a weight in accordance with the present invention; and FIG. 8 is a fragmentary cross-sectional view on an enlarged scale of an athletic implement shaft incorporating an added weight in accordance with of the present invention.

DETAILED DESCRIPTION OF THE PREFERRED EMBODIMENTS

Figure 1:
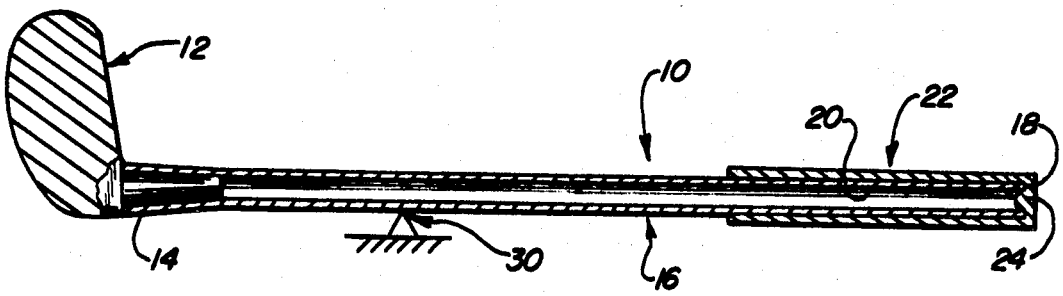
FIG. 1 is a cross-sectional view showing a conventional golf club.

While this invention is susceptible of embodiment in many different forms, there is shown in the drawing and described herein in detail, specific preferred embodiments of the invention, with the understanding that the present disclosure is to be considered as an exemplification of the principles of the invention and is not intended to limit the invention to the embodiments illustrated.

Referring to FIG. 1, a conventional golf club 10 includes a head 12 for engaging and striking a golf ball. The head of the club extends from a toe at the front to a heel at the back. The head typically includes a neck or socket 14 that is in line with the heel. The club also includes a shaft 16 that is secured to the neck of the head. One end of the shaft is secured to the head, and the other end terminates at an outer or distal end 18. The shaft is generally straight and hollow, although it may be tapered, and defines a passageway or opening 20, which also may be tapered.

The golf club also includes a relatively light-weight grip 22 that is adapted to be held by the hands of a player. The grip may include a plug portion 24 that closes the opening 20 defined by the shaft at the outer end 18 thereof. The grip also includes an annular gripping portion 26 that covers the shaft and extends from the outer end 18 of the shaft towards the head. The gripping portion 26 typically extends for about one-third of the length of the shaft.

The golf club has a center of gravity or balance point 30 when it is positioned generally horizontally. The balance point is easily located by balancing the golf club on a pointed object, such as one's index finger. Since most of the weight in a golf club is in the head, the balance point 30 is located on the shaft at a position that is closer to the head 12 than to the outer end 18 of the shaft.

The weight of the components of conventional golf clubs is usually about two ounces for the relatively light-weight grip, between about three ounces and about five ounces for the shaft depending on the composition and density of the alloy or material from which it is made, between about seven ounces and about eleven ounces for the heads on irons, and between about six ounces and about nine ounces for the heads of woods. The weight of the head increases on average about one-fourth of an ounce for each iron as the number of the iron increases; for example, the head of the six iron might weigh about one ounce more than the head of the two iron.

Although attempts have been made to add weights to golf clubs at positions between the balance point 30 and the outer end 18 of the shaft to augment the weight of the club adjacent the outer end 18, such attempts have not been successful. A weight located above the balance point shifts the balance point somewhere between location 30 and the outer end 18 of the shaft.

Weights have been positioned in the area that is held by a person using the club to move the center of gravity towards the area that is held. This is to enable a person swinging the golf club to exert greater control and accuracy over the swing, and lessens the tendency of the mass of the head to cause the swinging golf club to deviate from the desired plane of movement.

In the past, weight members have been formed from a variety of materials and have been placed in golf clubs in a number of different ways, none of which have been successful.

Figure 2:
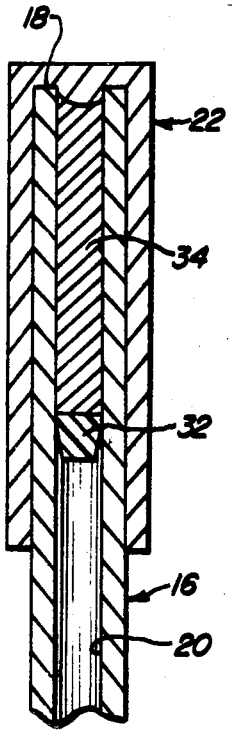
PRIOR ART FIG. 2
FIGS. 2–5 are a fragmentary cross-sectional view on an enlarged scale of golf clubs showing previous attempts to add weight which have not been successful.

FIGS. 2–5 illustrate a number of such attempts. In FIG. 2, a stop member such as a plug 32 is tapped down into the opening 20 when the grip 22 is removed. The plug was supposedly retained in position in the opening by means of frictional engagement with the inside wall of the shaft, and was typically formed of brass, copper, zinc, hard wood, or other materials. Molten or particulate materials, such as lead, were placed in the shaft to define a weighted insert 34. The plug 32 and weighted insert 34 together defined the weight member. The plug 32 was supposed to maintain the weighted insert in a fixed position in the shaft.

Alternatively, the weighted materials were preformed cylindrical solids that were press-fitted into the opening 20. Plugs were used in a futile attempt to retain the weighted insert in position in the shaft. It was thought that a press-fitted weighted insert in frictional engagement with the inside wall of the shaft would allow lighter materials to be used for the plug, such as rubber cork, wood dowels, neoprene, or other suitable materials. However such arrangements were not successful.

Figure 3:
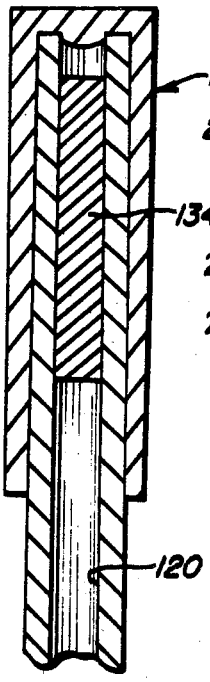
PRIOR ART FIG. 3

Alternatively, weighted inserts were all press-fitted into the shaft to be retained in position by means of frictional engagement, without the use of a plug, as shown in FIG. 3. This too has not worked satisfactorily.

Weights such as shown in FIGS. 2 and 3, were sometimes encapsulated in a plastic or rubber material before being inserted into the opening for the purpose of improving and increasing the frictional engagement between the weighted insert and the inside wall of the shaft. Such techniques did not overcome the tendency of the weights to move, nor did they eliminate undesirable sounds which arose when the club was swung and when it struck the object to be hit.

Figure 4:
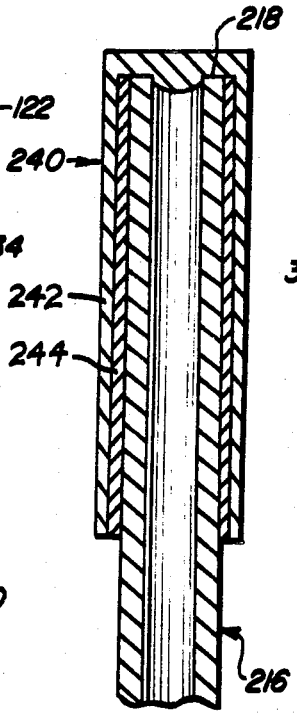
PRIOR ART FIG. 4
Figure 5:
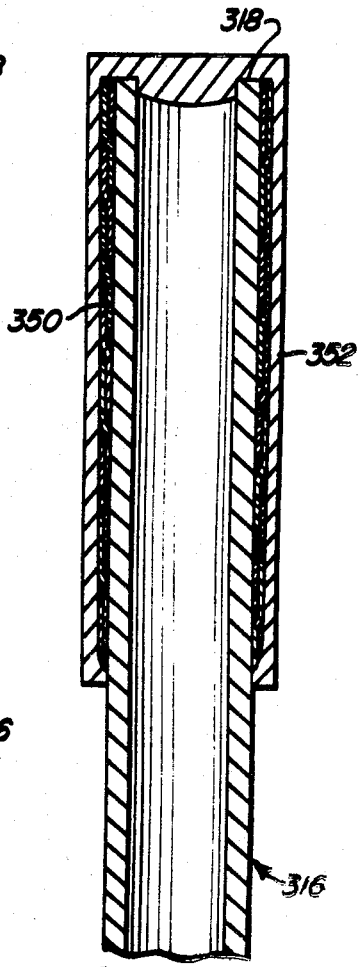
PRIOR ART FIG. 5

Other methods of adding weight to the gripping end of the golf club are shown in FIGS. 4 and 5. In FIG. 4, the golf club grip 240 overlies the shaft 216 of the golf club adjacent the outer end 218 of the shaft. The golf club grip 240 includes an outer layer 242 that is adapted to be held by the player. The weight means for the golf club comprises a layer 244 of lead, or other weighted material, that overlies the outside surface of the shaft 216 and is secured to, and covered by, the outer layer 242 of the grip.

The embodiment of FIG. 5 is similar in that the weighted material overlies the outside surface of the shaft 316 of the golf club adjacent the outer end 318 of the shaft. The weighted material 350 comprises tape or foil that is formed of lead or other suitable weighted materials, and which is wrapped around the outside surface of the shaft 316 adjacent the distal end 318 thereof. The grip 352 overlies, and covers, the weighted material 350. The weighted material can be secured either directly to the shaft 316, or to the grip 352. Such techniques do not do the job. Placement of a weight between the shaft and the grip typically changes the feel of the grip, or which uses a material such as lead which will not stand up under the stresses, to which the implement is subjected.

Referring to FIGS. 6–8 there is shown one embodiment of a weight member 470 suitable for use in conjunction with the present invention. The weight member 470 as shown in FIGS. 6–8 is adapted for insertion through the hollow, open distal end 418 of an athletic implement shaft 416, such as golf club 410 having a head 412.

In cross section, the shape of the weight member 470 will be the same as the cross-sectional shape of the passageway or opening 420 formed in the implement shaft 416. The weight member 470 is adapted to fit tightly within the opening 420 and frictionally engage the inner surfaces thereof and as described below to be retained in position without movement.

The overall length of the weight member 470, as shown in FIG. 7 is a function of the amount of weight that is to be inserted into the free end 418 of a particular shaft 416, and is also a function of the material from which the weight is made.

For use with golf clubs, such as club 410 shown in FIG. 6, in which the passageway 420 is typically circular in cross-section, the weight will be generally cylindrical having a reduced diameter portion 472 at one end thereof having a length of approximately ½ inch. The reduced diameter portion 472 at one end of the weight member 470, the insertion end, permits proper orientation of the weight member 470 and facilitates initial insertion into the free end 418 of the golf club 410.

The major portion 474 of the weight member 434 is of a diameter which, when covered with a sleeve as described below, is slightly larger than the inner diameter of the passageway 420 to provide for tight frictional engagement therebetween. This assists to maintain the position of the weight member 470 within the shaft 416 without movement of the weight within the shaft as the club is used.

The opposite or head end 476 of the weight member 470 has a somewhat enlarged diameter portion 478 which may be separated from the major portion by an undercut 479. The enlarged portion 478 increases the frictional engagement between the weight member 470 and the outer free end of the shaft 416, and terminates in an enlarged head defining flange 480 which rests on the outer end 418 of the shaft 412 to retain the weight in place.

One suitable material from which the weights can be made is a steel such as Ledloy 12L14. For use with golf clubs, weighting members of varying weight and therefore various lengths are typically utilized. For example, there can be a different weight for each wood, a different weight for each of most of the irons. There may be a maximum length and weight that is approprate, in order to prevent an adverse effect on the desired flexing of the shaft.

The following table illustrates examples of weights suitable for use in golf clubs, the weights being made out of the aforementioned steel.

| Club | 1 Orig. Club Weight | 2 Head Weight | 3 Added Weight | 4 3 as % of 2 | 5 Weight Length (inches) |
|---|---|---|---|---|---|
| Wood #1 | 13.11 | 6.82 | 3.66 | 53.67 | 3.78 |
| Wood #2 | 13.35 | 7.06 | 3.90 | 55.24 | |
| Wood #3 | 13.51 | 7.22 | 4.06 | 56.23 | 4.18 |
| Wood #4 | 13.74 | 7.45 | 4.29 | 57.58 | 4.41 |
| Wood #5 | 13.96 | 7.67 | 4.52 | 58.93 | 4.64 |
| Iron #2 | 14.06 | 7.86 | 3.20 | 40.71 | 3.32 |
| Iron #3 | 14.68 | 8.48 | 3.30 | 38.92 | 3.42 |
| Iron #4 | 14.93 | 8.73 | 3.40 | 38.95 | 3.52 |
| Iron #5 | 15.25 | 9.05 | 3.50 | 38.67 | 3.62 |
| Iron #6 | 15.36 | 9.16 | 3.60 | 39.30 | 3.72 |
| Iron #7 | 15.32 | 9.34 | 3.70 | 39.61 | 3.82 |
| Iron #8 | 15.36 | 9.38 | 3.80 | 40.51 | 3.92 |
| Iron #9 | 15.80 | 9.82 | 3.90 | 39.71 | 4.02 |
| Power Wedge | 15.83 | 9.85 | 4.00 | 40.61 | 4.12 |
| Sand Wedge | 16.98 | 11.00 | 4.00 | 36.36 | 4.12 |

A suitable grip 422 can then be placed over the end of the club.

The weight members 470 are covered with a sleeve 482 of a suitable material to increase the frictional engagement with the surface of the shaft. The sleeve material should be flexible and remain flexible over a wide range of temperatures. The sleeve also provides a sound deadening function to eliminate or minimize unwanted noises when a club incorporating the additional weight is used. The sleeve not only provides sound insulation, but the flexibility of the sleeve absorbs the stresses which occur in use. This inhibits or prevents damage to and destruction of the weight, which has occured in prior attempts to incorporate weights and which results in pieces of the weight moving within the shaft. When the sleeve 482 is to be used, the diameter of the uncoated weighting member is adjusted appropriately to accommodate the additional thickness resulting from the sleeve on the surface of the weight member. One material that is satisfactory for use as a sleeve and which retains its flexibility over a wide range of temperatures and which provides the desired noise inhibiting properties comprises a nylon/fiberglass coating over a cotton weave sold under the name Natvar. The sleeve is placed onto the surface of the weight, stretched and adhered thereto by a suitable adhesive, e.g., an epoxy such as those sold under the tradename Weldbond, Cycolac or Krel Laboratories' KL 101 Cement.

As seen in FIG. 8, the sleeved weight member 470 is inserted into the annular free end 418 of the golf club shaft 416 until the head 480 rests tightly against the end of the shaft. In this configuration, the sleeved weight 470 is tightly and frictionally engaged with the inner surface of the shaft 416 with the head 480 against the end of the and is thereby retained in place against any movement during the swinging of the athletic implement or club during use. This is particularly important since movement of the weight in the shaft is highly undesirable, would alter the characteristics of the club while in use, and would detract from the use of the club or implement incorporating the weight.

The weight member is positioned adjacent to the outer end 18 of the shaft, underlying the area that is held by the player who is using the golf club. This places more weight in the area where the player can best control the club's swinging movement, and shifts the balance point of the golf club closer to the player's hands, e.g., to a point about midway of the length of the club.

This invention is applicable to athletic implements which have a head portion at one end and a rod, handle or shaft at the opposite end, for holding the athletic implement. It is particularly adapted to those athletic devices, such as golf clubs, tennis rackets, baseball bats, and polo sticks, that have a relatively high percentage of their weight disposed within the head portion. In conventional golf clubs, for example, the weight of the head exceeds the weight of the remainder of the golf club. As a result, it is relatively difficult for a person swinging the golf club to precisely control the accuracy of the swing since the hands hold the golf club at the end that is furthest removed from the head end where the weight is concentrated.

For golf clubs, it has been found desirable to increase the weight of the grip end of the club by the addition of a weight which in irons is about 25% to about 45% of the weight of the head, and in woods is about 50% to about 60% of the weight of the head.

The present invention also contemplates that the weight of the head of the athletic implement, such as the golf club, can be increased or decreased. However, it is desirable to maintain a substantial enough weight at the head end of the implement to ensure that sufficient velocity is imparted to the ball when it is struck by the head. The speed that is imparted to the ball is a function of both the speed with which the head of the athletic implement is moving and the weight of the head.

As indicated above, the weight is added to the golf club in the form of a steel cylinder having a sleeve adhered to the surface thereof. The steel cylinder is inserted within the hollow shaft adjacent to the outer end of the shaft until the head abuts the end of the club shaft.

The amount of weight that is added to the club can be varied to accommodate the needs of individual players. In this manner, weight can be added to any golf club, including irons, wedges, and woods, or to other athletic implements.

From the foregoing, it will be observed that numerous variations and modifications may be effected without departing from the true spirit and scope of the novel concept of the invention. It is to be understood that no limitation with respect to the specific apparatus illustrated and described herein is intended or should be inferred. It is, of course, intended to be covered by the appended claims all such modifications that fall within the scope of the claims.

What is claimed is:

1. A golf club having a head that defines one end of said golf club and has a first predetermined weight, a hollow shaft having one end secured to the head and a second end that defines the opposite gripping end of said golf club, and a relatively light-weight grip secured to said shaft adjacent to said opposite end of said golf club, said golf club having a balance point at a location intermediate the ends thereof, said gripping end incorporating additional solid weight means inserted therein, the outer surface of said additional solid weight means being in intimate contact with the inner surface of said hollow shaft over the length of said solid weight means, said additional solid weight means incorporating a flexible material on the surface thereof to minimize the existence of noise from said additional solid weight means and to absorb thermal and mechanical stresses occuring during use of the club, said weight means having an enlarged head portion abutting the second end of said golf club for fixedly maintaining said additional weight means in position without movement thereof.

2. A golf club as defined in claim 1 wherein said additional weight means is secured to said golf club within one-third of said length of said golf club from said opposite end and the weight thereof is between about twenty-five percent and about sixty percent of the weight of said head.

3. A golf club having a head at one end and a hollow shaft at the opposite end, a grip secured to said golf club adjacent said opposite end, and a balance point at a location intermediate the ends of said golf club, solid weight means inserted in said golf club at said opposite end and extending toward said location, said solid weight means incorporating flexible sleeve means affixed to the surface thereof, the outer surface of said solid weight means being in intimate contact with the inner surface of said hollow shaft over the length of said solid weight means, and having an enlarged head portion abutting said opposite end of said club, whereby said weight means is fixedly retained in place in said shaft without movement and shifts the balance point of said golf club from said location to a point between said location and said opposite end of said club.

4. A golf club as defined in claim 3 wherein said sleeve means is adhesively adhered to said weight means.

5. A golf club as defined in claim 4 wherein said sleeve means incorporates a nylon-fiberglass coated cotton weave.

6. A golf club as defined in claim 3 wherein said golf club has a predetermined length, and said weight means is secured to said golf club within one-third of said length of said golf club from said opposite end.

7. A golf club as defined in claim 6 wherein said head has a first predetermined weight and said weight means has a second predetermined weight selected to be between about twenty-five percent and about sixty percent of the weight of said head.

8. A golf club as defined in claim 7 wherein the golf club is a wood as that term applies to golf clubs and said predetermined weight of said weight means is selected to be between about fifty percent and about sixty percent of the weight of said head.

9. A golf club as defined in claim 7 wherein the golf club is a wood as that term applies to golf clubs and said predetermined weight of said weight means is selected to be between about twenty-five percent and about forty-five percent of the weight of said head.

10. A golf club as defined in claim 3 wherein said weight means has a cross-sectional dimension slightly greater than the inside cross-sectional dimension of said hollow shaft, whereby said weight means is receivable in said shaft and secured thereto by means of frictional engagement.

11. An athletic implement having a head portion at one end and hollow shaft means extending from said head portion to an opposite end, said shaft means being secured to said head portion, grip means adjacent said opposite end for holding the implement, said athletic implement having a balance point at a location intermediate the ends thereof, and solid weight means inserted in said hollow shaft adjacent said opposite end, the outer surface of said solid weight means being in intimate contact with the inner surface of said hollow shaft over the length of said solid weight means, said solid weight means incorporating flexible sleeve means affixed to the surface thereof for absorbing thermal and mechanical stresses when said athletic implement is used, whereby said weight means is retained in place against movement and damage during use thereof, said solid weight means having an enlarged head portion abutting said opposite end of said shaft means for fixedly retaining said weight means in place without axial movement thereof along said shaft means, whereby said weight means shifts the balance point of said athletic implement from said location to a point between said location and said opposite end.

12. A method of improving the weight distribution of a golf club to enable a person to more accurately control the swing of the golf club, said golf club having a head and a hollow shaft with one end secured to the head and an opposite free end having a grip adjacent thereto, said golf club having a balance point at a location intermediate the ends thereof, comprising the steps of inserting weight means in said hollow shaft from said free end until an enlarged head portion of said weight abuts said free end thereby retaining said weight against movement relative to said shaft, and encasing said weight means in a flexible sleeve prior to insertion into said shaft, whereby any noise resulting from the presence of said weight means is minimized and movement of said weight in said shaft is further precluded.

* * * * *